United States Patent [19]

Eichenberger

[11] 4,221,242

[45] Sep. 9, 1980

[54] OPTICAL FILLING OR WEFT BOBBIN FEELER

[75] Inventor: Werner Eichenberger, Zürich, Switzerland

[73] Assignee: Gebrueder Leopfe AG, Wetzikon, Switzerland

[21] Appl. No.: 960,826

[22] Filed: Nov. 15, 1978

[30] Foreign Application Priority Data

Nov. 30, 1977 [CH] Switzerland ..... 14641/77

[51] Int. Cl.[2] ..... D03D 45/12

[52] U.S. Cl. ..... 139/273 A; 356/434

[58] Field of Search ..... 139/273 A, 370.2; 356/429, 430, 434, 435; 250/571

[56] References Cited

U.S. PATENT DOCUMENTS 2,432,171 12/1947 Payne ..... 139/273 A 3,693,671 9/1972 Desai ..... 139/273 A 3,892,492 7/1975 Eichenberger ..... 356/434

FOREIGN PATENT DOCUMENTS 420003 3/1967 Switzerland ..... 139/273 A

*Primary Examiner*—Henry Jaudon

*Attorney, Agent, or Firm*—Werner W. Kleeman

[57] ABSTRACT

An optoelectrical filling or weft bobbin feeler on a shuttle weaving machine, provided with a light source and a light sensor located in a casing which comprises at least one wall mounted in parallel relationship to the shuttle race. Light source and light sensor are arranged in the casing such that the optical axes define a plane forming a small acute angle with said one wall of the casing. Such a bobbin feeler functions to stop the loom in the instant when the thread winding on the bobbin runs out.

5 Claims, 4 Drawing Figures

OPTICAL FILLING OR WEFT BOBBIN FEELER

BACKGROUND OF THE INVENTION

The present invention relates to a novel and improved optoelectrical filling or weft bobbin feeler on a shuttle weaving loom, comprising a casing provided with at least one flat wall mounted in parallel relationship to the shuttle race or slay beam, and a light source and light sensor located in the casing and having optical axes intersecting in a point outside the casing.

Optoelectrical bobbin feelers of that type, briefly termed bobbin feelers in the following context, are disclosed in U.S. Pat. Nos. 3,693,671 and 3,892,492. These known bobbin feelers are provided with a further optoelectrical transducer (light source or sensor) arranged in the spatial angle between light source and light sensor.

The bobbin feeler of the first-named letters patent comprises a light source, a first photocell responding to specularly as well as diffusely reflected light emanating from the source, and a second photocell receiving only light diffusely reflected by the bobbin. The light beam necessary for scanning the bobbin is generated by a D.C.-supplied glow lamp. Discrimination of the conditions "bobbin covered" and "bobbin empty" is based on the fact that the bobbin substantially reflects diffusely when covered with a thread winding, the portion of the specularly reflected light then being small, whereas with the empty bobbin the reflection at the surface thereof is mainly specular.

According to the second-named letters patent, there are provided two alternately pulsed light sources, such as light emitting diodes, and a single light sensor, e.g. a phototransistor.

Usually, the known bobbin feelers are fixedly mounted at the frame of the loom and above one of the shuttle boxes, in such a manner that the optical axes of the optoelectrical transducers form a scanning plane parallel to the slay beam and perpendicular to the horizontal plane. The weft bobbin is scanned in its end position in the shuttle box when the slay is moving towards its frontal end position, i.e. shortly prior to the slay beat-up. During this forward movement of the slay, firstly the front edge and the swell of the shuttle box, followed by the front edge of the shuttle pass through the scanning plane, and finally by the weft bobbin to be scanned. Since said edges normally are smooth and thus are good reflectors, wrong signals may be triggered, simulating the condition "bobbin empty" and thus causing undesired loom stops.

SUMMARY OF THE INVENTION

It is the general and main objective of the invention to provide for a bobbin feeler on a weaving loom which avoids the aforementioned deficiency.

It is a more specific object of the invention to arrange the optoelectrical transducers provided in the bobbin feeler, such as light emitting and light receiving devices, in such a manner that light emanating from the emitting device or devices and specularly reflected from components of the weaving loom or the shuttle cannot affect the light receiving means such as to cause wrong stops of the weaving loom.

Now in order to implement the aforementioned objectives and others which will become more readily apparent as the description proceeds, the optoelectrical bobbin feeler of the invention is characterized by the improvement that the light source and light sensor are arranged such that the optical axes thereof define a scanning plane which forms an acute angle with the at least one flat wall of the casing.

By this novel arrangement, the light emanating from the light source and specularly reflected at the upper edges of the aforementioned loom components and shuttle can no longer strike the light sensor nor cause wrong stop signals.

By the inclination of the scanning plane, the weft bobbin sensing is not affected since the latter has a round or circular cross-section such that the scanning plane passes the surface of the bobbin in a particular position perpendicular to said surface where the responsivity of the bobbin feeler is greatest.

BRIEF DESCRIPTION OF THE DRAWINGS

The invention will be better understood and objects other than those set forth above will be apparent upon consideration of the following detailed description thereof which makes reference to the annexed drawings wherein.

DETAILED DESCRIPTION OF THE PREFERRED EMBODIMENTS

Figure 1:
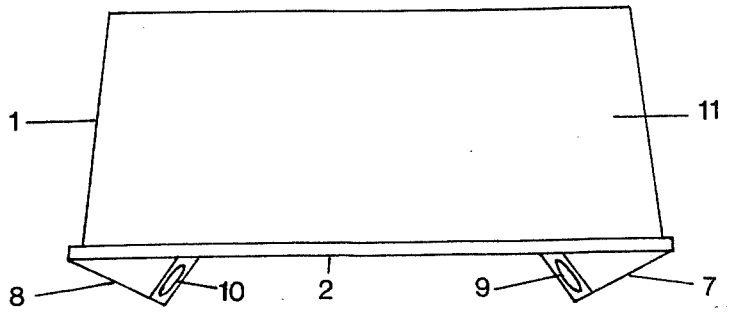
FIG. 1 is a front view of a weft bobbin feeler as used on a shuttle loom.
Figure 2:
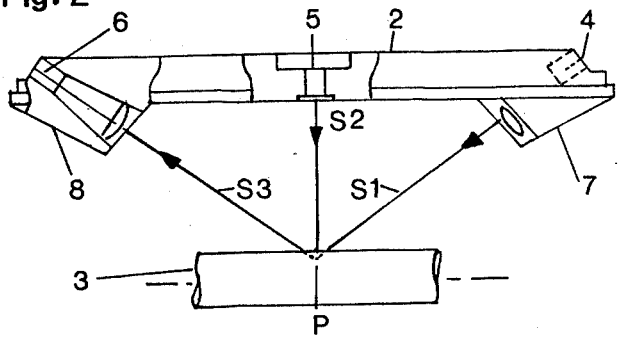
FIG. 2 is a view of the support beam to be attached to the housing of the bobbin feeler, and part of the weft bobbin.

FIG. 1 is a front view of the bobbin feeler, i.e. from the front side of the weaving loom. The bobbin feeler consists of two structural units, namely a casing 1 and a support beam 2 which is also shown in FIGS. 2 and 4, and bears the optical and electronic components of the bobbin feeler. Casing 1 is connected with support beam 2 by not shown fixing elements, such as screws. As may be seen from FIG. 3 the cross-section of casing 1 in a direction perpendicular to the drawing plane of FIG. 1 is U-shaped, the opening of the U facing downward to support beam 2. When mounted on the loom, the front wall 11 and rear wall 12 of casing 1 are perpendicular to the horizontal plane; the median plane M, FIG. 3, extends between the wall 11 and 12 in a vertical direction.

The arrangement of the optoelectrical transducers 4, 5 and 6 may be seen from FIG. 2 showing the support beam 2 with those portions in front of the transducers 5 and 6 broken away. There are provided in the present case two alternately pulsed light emitting diodes 4 and 5 and a light sensor 6 as described in the above mentioned U.S. Pat. No. 3,892,492. Alternatively there may be provided a single light source and two light sensors as shown in the U.S. Pat. No. 3,693,671.

At either end of the oblong support beam 2, and at the lower side thereof, there are provided two lugs 7 and 8 each having a bore extending in a direction inwards and downwards, the inner surfaces of which are each provided with a condenser lens 9 or 10, respectively. At the upper end of the bore in lug 7 there is provided a first light emitting diode 4 having an optical axis S1 coaxial with the one condenser lens 9. In a similar manner a phototransistor 6 serving as a light sensor is provided at the upper and outer end of the bore in lug 8. The optical axes S1 and S3 of light emitting diode 4 and phototransistor 6 define a scanning plane A, FIG. 3, sloping in forward direction, said axes S1 and S3 intersecting in a point P beneath the central region or middle of the length of the support beam 2. As shown in FIGS. 2 and 4, a second light emitting diode 5 is arranged at said central region or length middle, whose optical axis S2 also passes through the intersection point P.

Figure 3:
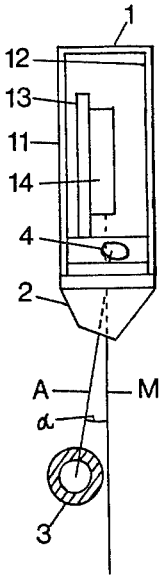
FIG. 3 is a vertical cross-sectional view through the bobbin feeler shown in FIG. 1.
Figure 4:
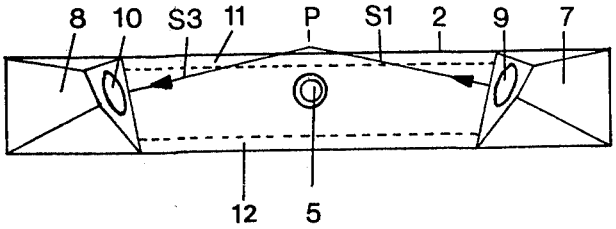
FIG. 4 is a view onto the lower surface of the support beam.

As may be seen from FIG. 3 the scanning plane A and the median plane M—and thus the front and rear walls 11 and 12—include an acute angle $\alpha$ which according to FIG. 3 is about 10°. However, this acute angle may vary in a range from 5° to 25°, depending on the construction of the above mentioned components of the weaving loom and the shuttle. Generally greater angles $\alpha$ may not be used in view of the spatial constructional conditions of shuttle weaving looms.

The second light emitting diode 5 must not necessarily be arranged in the length middle of support beam 2. With the arrangement shown in FIG. 2 the optical axis S2 of light emitting diode 5 is substantially perpendicular to the surface of weft bobbin 3 when the latter is being sensed. As shown in FIG. 3 a print plate 13 extending in perpendicular direction is fixed to support beam 2, bearing the electronic structural components which are represented schematically by a block 14.

By such a structural arrangement the optoelectrical transducers 4, 5 and 6 and print plate 13 as well as the electronic components 14 are readily accessible after disconnecting casing 1 and support beam 2.

While there is shown and described a present preferred embodiment of the invention, it is to be distinctly understood that the invention is not limited thereto, but may be otherwise variously embodied and practiced within the scope of the following claims.

Accordingly, what is claimed is:

1. In an optoelectrical bobbin feeler on a shuttle weaving loom containing a bobbin and a slay beam, said optoelectrical bobbin feeler comprising a casing having at least one flat wall capable of being mounted substantially parallel to the slay beam, optoelectrical transducing means comprising a light source, and a light sensor having optical axes which intersect in a point outside the casing, the improvement which comprises: the light source and light sensor being arranged such that the optical axes thereof define a scanning plane which forms an acute angle with said at least one flat wall of the casing for receiving light emitted by said light source and reflected by the bobbin.

2. The optoelectrical bobbin feeler as defined in claim 1, wherein the acute angle formed by the scanning plane and said at least one flat wall of the casing is in a range from 5 degrees to 25 degrees.

3. The optoelectrical bobbin feeler as defined in claim 1, wherein said casing is of oblong configuration and has an oblong opening facing the slay beam, and an oblong support bearing the optoelectrical transducing means is fitted into said oblong opening.

4. The optoelectrical bobbin feeler as defined in claim 1, wherein further optoelectrical transducing means is provided in a spatial angle between the light source and the light sensor.

5. The optoelectrical bobbin feeler as defined in claim 4, wherein said further optoelectrical transducing means is arranged such that the optoelectrical axis thereof intersects the optical axes of said light source and light sensor in the intersection point thereof.

* * * * *